US007781388B2

(12) United States Patent
Heintz et al.

(10) Patent No.: US 7,781,388 B2
(45) Date of Patent: Aug. 24, 2010

(54) CLEANING COMPOSITIONS FOR HARD TO REMOVE ORGANIC MATERIAL

(75) Inventors: Stavroula Maria Heintz, Freeburg, IL (US); Shannon K. Campbell, Wildwood, MO (US); Gurusamy Manivannan, St. Charles, MO (US)

(73) Assignee: American Sterilizer Company, Mentor, OH (US)

( * ) Notice: Subject to any disclaimer, the term of this patent is extended or adjusted under 35 U.S.C. 154(b) by 844 days.

(21) Appl. No.: 11/417,584

(22) Filed: May 4, 2006

(65) Prior Publication Data

US 2007/0259802 A1 Nov. 8, 2007

(51) Int. Cl.

| | |
|---|---|
| ***C11D 1/70*** | (2006.01) |
| ***C11D 1/72*** | (2006.01) |
| ***C11D 3/20*** | (2006.01) |
| ***C11D 3/39*** | (2006.01) |
| ***C11D 3/395*** | (2006.01) |

(52) U.S. Cl. ..... 510/238; 510/245; 510/254; 510/272; 510/422; 510/435; 510/470; 510/505; 510/506

(58) Field of Classification Search ..... 510/238, 510/245, 254, 272, 422, 435, 470, 505, 506
See application file for complete search history.

(56) References Cited

U.S. PATENT DOCUMENTS

| | | | |
|---|---|---|---|
| 4,233,174 | A | 11/1980 | Sheridan |
| 4,414,128 | A | 11/1983 | Goffinet |
| 5,747,794 | A | 5/1998 | Malchesky |
| 5,759,440 | A | 6/1998 | Van Hemelrijk |
| 5,855,217 | A | 1/1999 | John |
| 6,232,280 | B1 | 5/2001 | Shah et al. |
| 6,316,399 | B1 | 11/2001 | Melikyan et al. |
| 6,632,290 | B1 | 10/2003 | Shah et al. |
| 6,718,992 | B1 | 4/2004 | Cardola et al. |
| 6,767,881 | B1 | 7/2004 | Griese et al. |
| 6,846,793 | B1 | 1/2005 | Griese |
| 2002/0039988 | A1 | 4/2002 | Kasturi et al. |
| 2004/0259745 | A1 | 12/2004 | Asher et al. |
| 2005/0159328 | A1 | 7/2005 | Oberlander et al. |
| 2005/0181966 | A1 | 8/2005 | Micciche et al. |

FOREIGN PATENT DOCUMENTS

| | | |
|---|---|---|
| EP | 0 666 308 | 8/1995 |
| EP | 0 845 525 | 6/1998 |
| WO | 94/11474 | 5/1994 |
| WO | 96/30485 | 10/1996 |
| WO | 01/72272 | 10/2001 |
| WO | 03/092917 | 11/2003 |

*Primary Examiner*—Gregory R Del Cotto
(74) *Attorney, Agent, or Firm*—Hudak, Shunk & Farine Co. LPA

(57) ABSTRACT

An oxidizing cleaning composition comprises a low concentration of aqueous hydrogen peroxide that is environmentally friendly and has good stability in strong alkaline solutions. The aqueous hydrogen peroxide composition contains a synergistic combination of one or more hydrophilic surfactants having an HLB of 10 or greater, one or more hydrotropes, one or more UV-analyzable surfactants having an aromatic detectable functional group, and optionally a surfactant having an HLB of less than 10. The cleaning composition when mixed with an alkaline compound is very effective in removing dried or baked residues of polymers, modified or natural celluloses starches, natural gels, and the like at low concentrations and temperatures.

10 Claims, No Drawings

CLEANING COMPOSITIONS FOR HARD TO REMOVE ORGANIC MATERIAL

FIELD OF THE INVENTION

The present invention relates to a cleaning composition comprising one or more oxidizing agents, one or more ultraviolet light analyzable surfactants, one or more surfactants having an HLB value of 10 to 20, one or more surfactants having an HLB value of greater than 20, and optionally one or more surfactants having an HLB of less than 10. The composition, especially in combination with an alkaline compound or alkaline formulated cleaner, is effective in removing polymer residues, hydrophilic soils, and otherwise hard to remove residues and materials from a substrate. After utilization and rinsing, a determination of the rinsate utilizing high performance liquid chromatography with ultraviolet (UV) detectors to detect any remaining cleaning composition residue to predetermined acceptable levels offers significant advantages in the cleaning validation of the manufacturing process. Cleaning validation ensures that specific cleaning processes offer consistent cleaning to pre-determined limits to prevent contaminants from product or remnants of the cleaning composition that will adulterate and adversely affect the quality and safety of the next manufactured product.

For pharmaceutical manufacturing applications, the detectable substance is preferably a low-foaming surfactant of the cleaning composition (at concentrations of around 10 ppm, or less). This detection also offers significant advantages to the manufacturers by analyzing the surfactant and pharmaceutical residues which have not been removed from the reaction vessels through the same analytical procedure and method.

Identification of a detectable substance in the cleaning composition indicates whether the cleaning composition has been thoroughly removed from a vessel after it has been employed in a cleaning process. It is preferred in the industry to use a detection method involving high performance liquid chromatography at concentrations of around 10 ppm, or less in addition to other available methods. A cleaning composition with analyzable surfactant offers dual advantages since the same analytical procedure that is used to monitor the pharmaceutical residues will be used to track down the surfactant and validate the cleaning process.

BACKGROUND OF THE INVENTION

The use of alkaline oxidizing chemical compositions has been limited for various reasons such as limited stability of oxidants in alkaline environment. For example, chlorine containing products are highly corrosive to equipment and pose safety hazards to employees and the environment. Additionally, many oxygen generators are solids such as various perborates or percarbonates that must be dissolved prior to use and they have limited stability and solubility in aqueous alkaline solutions. It is also well known to the art and to the literature that, hydrogen peroxide is unstable at a pH greater than 7.0 and the levels of hydrogen peroxide at greater than 8 percent by weight in water are classified as a hazardous material for transport purposes as per DOT regulations (49CFR, Part 172).

Another major drawback of prior art cleaning solutions is that, it is often difficult to detect whether any cleaning solution or surfactant from the cleaning solution remains on the cleansed surface in order to validate a cleaning process. Detection often requires the use of suitable analytical methods in measuring the analyte at and below the acceptance residue limit involving specific and nonspecific methods to determine the presence or absence of component of a cleaning solution, preferably an active compound or surfactant. Examples of specific methods that detect a unique compound in the presence of potential contaminants are, but not limited to: High Performance Liquid Chromatography (HPLC), ion chromatography, atomic absorption, inductively coupled plasma (ICP), and capillary electrophoresis. Examples of nonspecific methods are, but not limited to: total organic carbon (TOC), pH, titrations and conductivity.

Prior art cleaning solutions or compositions are set forth in various patents.

U.S. Pat. No. 4,233,174 to Sheridan relates to a cleaning composition which comprises: (a) from 35 to 80 wt % of one or both of a fatty alcohol ethoxylate (having from 8 to 18 carbon atoms in the alcohol moiety and from 2 to 10 moles ethylene oxide per mole alcohol) and a higher alkyl phenol ethoxylate (having from 8 to 12 carbon atoms in the alkyl moiety and from 4 to 10 moles ethylene oxide per mole phenol); and (b) from 65 to 20 wt % of a phenol, or lower alkyl phenol, ethoxylate having from 1 to 4 carbon atoms in the alkyl group (if present) and from 3 to 10 moles ethylene oxide per mole phenol.

U.S. Pat. No. 4,414,128 to Goffinet relates to liquid detergent compositions, particularly for use as hard surface cleaners, comprising 1%-20% surfactant, 0.5%-10% mono- or sesquiterpenes, and 0.5%-10% of a polar solvent having solubility in water of from 0.2% to 10%, preferably benzyl alcohol.

U.S. Pat. No. 5,759,440 to Van Hemelrijk relates to an aqueous solution of hydrogen peroxide allegedly stabilized by incorporation of a composition containing a mixture of an alkali metal pyrophosphate or alkaline earth metal pyrophosphate with a stabilizer belonging to the category of aminopolycarboxylic acids corresponding to the following general formula:

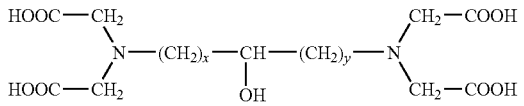

where x and y are integers equal to 0, 1 or 2 and salts of these acids.

U.S. Pat. No. 5,855,217 to John Andreas relates to a device for cleaning surfaces which are soiled in the food industry with grease, starch or protein residues including: a housing body having a first inlet for feeding pressurized water; a propulsion jet positioned behind the inlet and in a direction of flow; a collection jet positioned behind the propulsion jet which is flow connected with a second inlet for feeding a chlorine-free alkaline foam cleaning agent and a third inlet for feeding a hydrogen peroxide solution; and a turbulence chamber into which an elongated jet body of the collection jet extends, the turbulence chamber fitted with a chamber inlet for feeding compressed air into the chamber such that, a hydrogen peroxide foam is formed from a solution formed upon dosing an effective amount of the hydrogen peroxide solution into the chlorine-free alkaline foam cleaner at a maximum of 60 seconds prior to contact of the hydrogen peroxide foam with a surface to be cleaned, the turbulence chamber further having a chamber outlet through which the hydrogen peroxide foam leaves the chamber to contact the surface, the chamber inlet and the chamber outlet being fitted in a direction of flow ahead of an outlet orifice of the jet body.

U.S. Pat. No. 6,316,399 to Melikyan et al. relates to a cleaning composition including a terpene such as D-limonene or Orange oil and hydrogen peroxide or an alkaline stable peroxide in a surfactant based aqueous solution.

U.S. Pat. No. 6,767,881 to Griese relates to compositions that include: (a) a terpene compound; (b) a surfactant; and (c) an ethoxylated aryl alcohol.

U.S. Pat. No. 6,846,793 to Griese relates to compositions that include: a surfactant having an HLB value from 1 to 10; and a compound of formula (I):

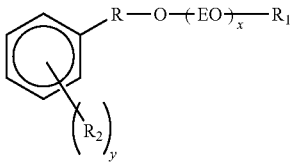

where; x is an integer from 2 to 6, y is an integer from 0 to 5, R is a bond or $(C_1\text{-}C_4)$alkylene, $R_1$ is a hydrogen, halo, aryl, $(C_1\text{-}C_4)$alkyl, heteroaryl, cycloalkyl, or heterocycyl, $R_2$ is independently selected from hydrogen, halo, $(C_1\text{-}C_4)$alkyl, $(C_1\text{-}C_4)$alkoxy, $(C_2\text{-}C_4)$ alkenylene.

U.S. Publication 2004/0259745 to Asher relates to a cleaning solution for paper making equipment including an alleged stabilized source of peroxide in combination with a glycol ether solvent system and an alcohol ethoxylate. The peroxide system can be hydrogen peroxide stabilized with a phosphonate such as 1-hydroxy ethylidene (1,1-diphosphonic acid) (HEDP). The glycol solvent system may be propylene glycol ether such as dipropylene glycol methylether or tripropylene glycol methylether. This solution can be formulated with a pH from about 4 to about 12.

European Patent 0845525 to Eka Chemicals AB allegedly relates to a composition suitable for cleaning disinfection and bleaching comprising an acidic aqueous solution of hydrogen peroxide, a surfactant, and a phosphonic acid based complexing agent selected from biodegradable 1-aminoalkane-1,1-diphosphonic acids, or salts thereof, of the formula:

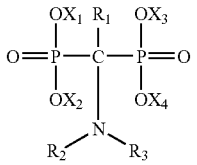

wherein R1 is selected from hydrogen, C1-C4 alkyl and phenyl; R2 and R3, independently from each other, are selected from hydrogen, C1-C22 alkyl, C5-C6 cycloalkyl, phenyl, C7-C18 alkylphenyl, C7-C18 phenylalkyl, a C1-C10 alkanol radical, a carboxy alkyl radical having up to 10 carbon atoms, wherein R2 and R3 together with the nitrogen atom can form a piperidino, pyrrolidino or a morpholino group; and X1 to X4, independently from each other, are selected from hydrogen, alkali metal and ammonium.

WO 01/72272 to The Procter & Gamble Company relates to an alkaline hair bleaching composition comprising two parts wherein one part has an oxidizing agent and other part has a buffering agent: (a) from about 0.01% to about 12%, by weight, of at least one oxidizing agent; (b) from about 0.2% to about 20%, by weight, of a buffering system, present in an amount sufficient to generate a pH of the composition in the range from about 5 to about 11, wherein said buffering system comprises at least one pH modifying ingredient selected from the group consisting of (i) borate buffers, (ii) alkalizing agents, and mixtures thereof; (c) from about 150 ppm to about 5,000 ppm of at least one stabilizer; and (d) from about 0.01% to about 50%, by weight, of at least one hair care ingredient selected from the group consisting of (i) surfactants, (ii) catalysts, (iii) thickeners, (iv) conditioners, and mixtures thereof.

WO 03/092917 to Ecolab Inc. relates to the disclosed use of and a method for cleaning surfaces of medical production facilities by means of aqueous alkaline cleaning solutions and active oxygen.

European Patent 0666308 to The Procter & Gamble Company relates to an aqueous cleaning compositions comprising hydrogen peroxide, a 2-alkyl alkanol, a hydrophobic surfactant having an HLB below 14 and an anionic surfactant. The invention also encompasses the use of 2-alkyl alkanols together with hydrophobic surfactants, in aqueous cleaning compositions, so as to allegedly improve the greasy cleaning of said compositions.

WO 94/11474 to The Procter & Gamble Company relates to cleaning compositions which are reportedly pseudoplastic and thixotropic liquids. Such suitable compositions can be prepared in the form of aqueous emulsions of nonionic surfactants.

WO 96/30485 to the Warwick International Group Limited relates to concentrated aqueous alkaline isotropic liquid detergent composition comprising a mixture of nonionic and anionic surfactants and dissolved hydrogen peroxide. The mixture also contains a hydrotrope selected from the group comprising polyhydric alcohols with a flashpoint greater than 30° C., and other alcohols with a flashpoint greater than 30° C. or mixtures thereof.

Moreover, industries such as the pharmaceutical industry clean their manufacturing tanks and other processing equipments with detergent-based cleaners to remove traces of the products processed in the equipment. It is critically important to ensure that, the cleaning process has effectively removed drugs and cleaning product residues from the equipment avoiding cross contamination from one batch of the product to another and avoid any negative impact. The Food and Drug Administration (FDA) also requires that tests be conducted to validate the cleaning process. It is a common practice to determine the level of residual cleaning product by a non-specific analytical method, such as Total Organic Carbon (TOC) analysis. This approach is limited in that it only offers information about the water-soluble carbon content of all components in the residue and not about specific components in the cleaning product. High Performance Liquid Chromatography (HPLC) is the method of choice for determining the level of residual pharmaceutical product on the equipment. It is a highly sensitive analytical technique in detecting specific components of the residue and/or cleaning composition. Most components of cleaning products may not contain a detectable species, or chromophore, which can be detected by the HPLC with UV detectors. HPLC uses a combination of chromatography for separating the rinsate into components, and UV/visible spectroscopy at a fixed wavelength for detection, dependent on the component to be analyzed. The HPLC is thus set to detect for signals at two (or more) wavelengths, one corresponding to a known component of the pharmaceutical product or other chemical expected to be left in the equipment after processing, and one corresponding to the detectable substance. The FDA requires that, equipment be clean prior to use is nothing new, the 1963 GMP regulations (Part 133.4) and in 1978 CGMP regulations (211.67) with the main rationale for requiring clean equipment is to prevent contamination or adulteration of drug products. Though the FDA does not intend to set acceptance specifications or methods for determining whether a cleaning process is validated, some limits that have been mentioned by industry representatives in the literature or in presentations include analytical detection levels such as 10 ppm, biological activity levels such as 1/1000 of the normal therapeutic dose, and organoleptic levels such as no visible residue. It is impractical for FDA to set the acceptance specifications due to the wide variation in equipment and products.

SUMMARY OF THE INVENTION

The cleaning compositions of the present invention containing an oxidizing agent in combination with other cleaning compounds have environmentally friendly ingredients and utilize various types of surfactants which yield synergistic results with regard to cleaning ability and extended stability of the oxidizing agent either alone or when used with alkaline compounds, and are also low foaming and can be used for high-energy spray applications. They can also be used to boost the cleaning efficacy of both alkaline and acidic cleaners in spray and manual cleaning applications. Their surfactancy and oxidizing chemistry allow for a multitude of cleaning mechanisms. The cleaning compositions can be effectively used to clean hard to remove soils of the pharmaceutical, personal care, nutraceutical and other industries requiring effective, validatable cleaning. The surfactants comprise at least one hydrophilic surfactant that has a hydrophile-lipophile balance (HLB) value of 10 to 20 and comprise surfactants such as primary and secondary alcohol alkoxylates containing a relatively small number of carbon atoms derived from the alcohol and a relatively large number of repeat groups of alkylene oxides having from 2 to about 4 carbon atoms. Another component of the cleaning composition is a hydrotrope which is utilized to stabilize the various surfactants in order to allow them to remain soluble in an acidic or an alkaline aqueous solution. Hydrotropes include various alkyl glucosides or alkyl polyglucosides, various modified carboxylic acids or carboxylates, various phosphate esters, various quaternary fatty amine ethoxylates, various amino compounds such as coco imino organo compounds, and various alkyl amino organo compounds. An optional but desired surfactant or combination of surfactants include various hydrophobic surfactants which have an HLB value of less than 10 such as various alcohol alkoxylates wherein the hydrocarbon portion derived from the alcohol has a relatively high number of carbon atoms and the alkylene oxide has a relatively low number of repeat groups.

An important aspect of the present invention is the utilization of an ultraviolet light analyzable surfactant that contains a chromophore such as UV analyzable aromatic functional group. In general, a validatable cleaning method comprising: (a) cleaning the surface with a cleaning composition which contains a detectable, stable substance, (b) rinsing the surface to remove the cleaning composition to produce a rinsate; and (c) analyzing the rinsate using high performance liquid chromatography for the detectable substance such as a surfactant that is detectable at a concentration of 10 ppm or below to serve as an indicator of whether the cleaning composition has been removed from the surface. By stable, it is meant that the surfactant does not appreciably degrade (i.e., the detectable substance does not degrade and become undetectable) over the expected storage lifetime of the cleaning composition.

Conventional surfactants used in the cleaning products tend to degrade over time due to the highly alkaline or acidic pH of the product and thus are not capable of acting as stable indicators for the cleaning product during the entire life of the product. The present invention provides a new and improved cleaning composition and method for detection of residual cleaning composition after cleaning which overcomes the above-referenced problems and others.

To optimize or maximize the cleansing ability of the cleaning compositions of the present invention, an alkaline compound is often utilized such as sodium hydroxide or potassium hydroxide or an alkaline formulated cleaner.

The cleaning compositions can be used for removing various residues such as dried or baked polymer and have several advantages over conventional cleaning systems in that they are environmentally friendly since they are biodegradable, non-toxic, non-hazardous, low foaming, and have a UV analyzable surfactant with respect to detecting any cleaning composition residue in rinse water. By "biodegradable" it is meant but not limited to the definition of "the structural change (transformation) of a surfactant by micro-organisms resulting in the loss of its surface-active properties due to the degradation of the parent substance and consequential loss of the surfactant-active property measured by test methods listed in Annex II, Official Journal of the European Union 8.4.2004 (Article 2, Definitions 6 and 7)". Another significant advantage is that, the cleaning compositions are very stable and that the decomposition rate of the oxidizing agent such as hydrogen peroxide is very low even in the presence of an alkaline compound or formulated alkaline cleaner.

Accordingly, an aspect of the present invention is an aqueous cleaning composition, comprising: a) at least one oxidizing agent in an amount of from about 2% to about 8% by weight based upon the total weight of said cleaning composition, said oxidizing agent comprising an inorganic peroxide or an organic peroxide or a salt thereof, a halogen compound, or an alkylating agent, or combinations thereof; b) at least one hydrophilic surfactant having an HLB value of 10 to 20 in an amount of from about 2% to about 9.5% by weight based upon the total weight of said cleaning composition; c) at least one hydrotrope surfactant having an HLB value of greater than 20 in an amount of from about 2.5% to about 12% by weight based upon the total weight of said cleaning solution; d) at least one ultraviolet light analyzable phenol alkoxide surfactant in an amount of from about 1% to about 8% by weight based upon the total weight of said cleaning solution, said analyzable surfactant having an analyzable functional group capable of being analyzed at a wavelength from about 250 to about 290 nanometers; e) optionally at least one hydrophobic surfactant having an HLB value of less than 10 in an amount of from a out 1% to about 8% by weight based upon the total weight of said cleaning composition; and water.

Another aspect of the present invention relates to a process for removing a residue from a substrate, comprising the steps of: preparing a diluted cleaning solution, said diluted cleaning solution made by adding water to a concentrated cleaning solution so that the amount of oxidizing agent therein is from about 0.005% to about 1.9% by weight of said cleaning solution, said concentrated cleaning solution comprising: a) at least one oxidizing agent in an amount of from about 2% to about 8% by weight based upon the total weight of said cleaning composition, said oxidizing agent comprising an inorganic peroxide or an organic peroxide or a salt thereof, a halogen compound or an alkylating agent, or combinations thereof; b) at least one hydrophilic surfactant having an HLB value of 10 to 20 in an amount of from about 2% to about 9.5% by weight based upon the total weight of said cleaning composition; c) at least one hydrotrope surfactant having an HLB value of greater than 20 in an amount of from about 2.5% to about 12% by weight based upon the total weight of said cleaning solution; d) at least one ultraviolet light analyzable phenol alkoxide surfactant in an amount of from about 1% to about 8% by weight based upon the total weight of said cleaning solution, said analyzable surfactant having an analyzable functional group capable of being analyzed at a wavelength from about 250 to about 290 nanometers; and water; applying said diluted cleaning solution to the residue; optionally adding an amount of an alkaline compound to said cleaning solution so that the pH thereof is from about 9 to about 14; and removing said residue by rinsing with a fluid.

DETAILED DESCRIPTION OF THE INVENTION

The "green" or environmentally friendly aqueous cleaning composition of the present invention contains an oxidizing agent that includes organic and inorganic peroxides including salts thereof, halogens, various alkylating agents, and combinations thereof. Examples of peroxides and salts thereof include hydrogen peroxide, peracetic acid, percarbonic acid, perlauric acid, perglutaric acid, persulfuric acid, magnesium peroxyphthalate, peroxomonosulfate, peroxodisulfate, sodium percarbonate, sodium perborate monohydrate, urea peroxide, and combinations thereof. Preferred compounds include peracetic acid with hydrogen peroxide being highly preferred. Halogens include various chlorine compounds such as hypochlorite and other hapohalite compounds such as bleach chlorite, chlorate, perchlorate, and other analogous halogen compounds. Other halogens include various iodine compounds such as various iodates and iodophors, and various bromine compounds including various bromates. The alkylating agents include ethylene oxide, propylene oxide, and the like.

The oxidizing agents are preferably made and distributed in concentrated form in an aqueous solution containing various surfactants. However, prior to application the concentrated aqueous cleaning solutions are diluted to suitable end use levels. The concentrated amount of the various oxidizing agents such as hydrogen peroxide can range from about 2.0% to about 8% or less by weight, desirably from about 3% to about 7% by weight and preferably from about 4% to about 6% by weight based upon the total weight of the aqueous cleaning solution. The amount of oxidizing agent in diluted aqueous cleaning solutions generally range from about 0.005% or about 0.01% to about 1.9% by weight, desirably from about 0.02% to about 0.5% by weight and preferably from about 0.025% to about 0.20% by weight based upon the total weight of the aqueous cleaning solution.

The hydrophilic surfactants have an HLB value of from 10 to 20 and preferably from about 10.5 to about 18 and are typically nonionic surfactants such as those having the formula R—O-$(EO)_m(PO)_n$—R' where E is ethylene and P is propylene, m is an integer of from 1 to about 10 and preferably from about 3 or 4 to about 6, n is an integer of from 0 or 1 to about 10, desirably 3 to 5, and preferably 0, R is derived from a primary or secondary alkyl alcohol and has a total of from 1 to about 13 and desirably from about 8 to about 13 carbon atoms, and R' is an alkyl having from 1 to about 5 carbon atoms and preferably is hydrogen. Generally, the lower the number of carbon atoms in the R group and the larger the m and n integers, the higher the HLB value. Examples of suitable nonionic hydrophilic surfactants include Berol 260 wherein the HBL value is 10.5, R contains 9 to 11 carbon atoms, m is 4, n is 0 and R' is hydrogen; and Berol 840 wherein the HBL value is 11.5, R is a branched alkyl containing a total of 8 carbon atoms such as ethyl-hexyl, m is 5.5, n is 0 and R' is hydrogen. Other nonionic surfactants include Neodol 1-9 wherein R contains 11 carbon atoms, R' is hydrogen, m is approximately 9 and n is 0, and Neodol 1-5 wherein R contains 11 carbon atoms, R' is hydrogen, m is approximately 5 and n is 0.

The total amount of one or more hydrophilic surfactants having an HLB value of 10 or more to 20 is generally from about 2.0% to about 9.5%, desirably from about 3.5% to about 8.0%, and preferably from about 4.5% to about 7.0% by weight based upon the total weight of the aqueous concentrated cleaning solution.

The hydrotrope surfactants utilized in the present invention are generally very hydrophilic compounds and one or more different classes of hydrotropes can be utilized. Hydrotropes are generally defined as a chemical that has the ability to increase the water solubility of slightly soluble organic compounds. They also impart shelf life stability and have an HLB value of greater than 20 and generally to about 30, or about 35.

One class of hydrotropes is the various modified carboxylic acids or carboxylates that generally contain an alkyl group having from about 6 to about 18 carbon atoms. An example is an active sodium salt of a modified carboxylic acid, sodium alkanoate known as DeTROPE SA-45 from DeFOREST, a proprietary compound that has low foaming properties, is biodegradable, and is non-phenolic. A 100% active modified carboxylate is DeTROPE CA-100, also a proprietary compound that also functions as a corrosion inhibitor. This compound is also biodegradable and non-phenolic.

Various types of phosphate-based hydrotropes that have from about 4 or about 6 to about 18 or about 20 carbon atoms can also be utilized such as a 50% active organophosphate amphoteric as for example DePHOTROPE CAS-MF which also has good wetting properties and is biodegradable. A low foaming modified phosphate ester in a free acid form is DePHOTROPE LFW-98. Yet another phosphate based hydrotrope is a 50% active potassium salt of an aromatic phosphate ester such as DePHOS H-66-872 which has low foaming properties. All of the above phosphate-based hydrotropes are proprietary compounds available from DeFOREST of Boca Raton, Fla. Another phosphate hydrotrope is a potassium salt of a phosphate ester salt under the tradename Berol 522 available from Akzo Nobel of Boxmeer, the Netherlands.

Another class of hydrotropes includes various organic nitrogen containing compounds such as amino compounds as for example a complex of coco imino glycinate, a complex of coco imino dipropionate, or an octyl amino dipropionate respectfully available as Ampholak XKE, Ampholak YCE, and Ampholak YJH-40 made by AKZO Nobel of Boxmeer, the Netherlands.

The various fatty quaternary amine alkoxylates wherein the alkyl group has from 8 to 16 carbon atoms such as an ethoxylate constitute another class of a hydrotrope such as Berol 556 and Berol 563 available from Akzo-Nobel of Boxmeer, the Netherlands.

A preferred class of hydrotropes includes various alkyl glucosides and alkyl polyglucosides wherein the alkyl group has from about 8 to about 16 carbon atoms. An example of an alkyl glucoside is Berol AG 6206.

The amount of the one or more hydrotropes generally ranges from about 2.5% to about 12% by weight, desirably from about 4% to about 10% by weight and preferably from about 5.5% to about 8.5% by weight based upon the total weight of the aqueous concentrated cleaning composition.

An important aspect of the present invention is the utilization of an analyzable surfactant which contains a UV analyzable functional group such as benzene ring and generally has an HLB value of from about 5 to about 18 and desirably from about 7 to about 13. Such surfactants are utilized to verify or validate the effectiveness of a rinse cycle after the surfactant composition has been applied to a residue. The utilization of a UV analyzable surfactant has also been found to unexpectedly and synergistically improve the stability of the oxidizing agent such as hydrogen peroxide, especially in alkaline solutions. Examples of UV detectable compounds include phenol alkyloxides having a plurality of alkylene oxide groups such as from about 1 to about 20 with from about 2 to about 16 being desired and about 3 to about 6 groups, with 4 being highly preferred. The alkylene oxide repeat units can contain 2, 3, or 4 carbon atoms with 2 carbon atoms and 1 oxygen atom, i.e., ethylene oxide groups, being preferred. The phenol group can optionally be substituted with from 1 or 2, desirably 1 alkyl group(s) each, independently, containing from about 1 to about 12 and desirably about 6 to about 10 carbon atoms such as octyl and nonyl phenol ethoxylates wherein the moles of ethoxylation can generally vary from 1 to about 16. Examples of specific nonyl phenol ethoxylates include Igepal CO 210 that has 1.5 moles of ethoxylation and an HLB value of 4.6, Igepal CO 530 that has 6 moles of ethoxylation and an HLB value of 10.8, Igepal CO 630 that has 9.3 moles of ethoxylation and an HLB value of 13, and Igepal CO 730 that has 15 moles of ethoxylation and an HLB value of 15. The Igepal compounds are made by Stepan Corporation. Preferably the UV detectable surfactant contains no substitute alkyl groups. Thus, a highly preferred UV detectable surfactant is phenol alkoxylated with 4 moles of ethylene oxide available as Ethylan HB-4 made by Akzo-Nobel and has an HLB value of 8.8.

The ultraviolet light wavelength for detection of the presence of any residual UV detectable surfactant such as in rinse water is approximately 250 to about 290 nanometers, desirably from about 265 to about 275, and preferably about 270 nanometers.

The amount of the one or more UV analyzable surfactants is generally from about 1% to about 8% by weight, desirably from about 3% to about 7% by weight, and preferably from about 4% to about 6% by weight based upon the total weight of the aqueous concentrated cleaning solution.

An optional surfactant is the use of a hydrophobic surfactant which has an HLB value of less than 10, desirably about 3 to about 9.5 and preferably from about 7 to about 9. One class of compounds is the various nonionic hydrophobic alkoxylated alcohols but unlike the above hydrophilic alkoxylated alcohols, the hydrophobic alkoxylated alcohols have generally about 8, or about 11, or about 12 to about 15 or about 20 carbon atoms which are derived from the alcohol and about 4, or desirably 3 or 2 repeat alkylene oxide groups wherein the alkylene contains from 2 to 4 carbon atoms and preferably has two carbon atoms. While the number of carbon atoms derived from the alcohol as well as the number of repeat alkylene oxide groups may overlap between the hydrophobic surfactant and the hydrophobic surfactant, the key as to the identity of the compound is the HLB value thereof. Examples of hydrophilic alkylene oxide alcohols include Tomadol 91-2.5 which has an HLB value of approximately 8.5; Tomodol 1-3 which has an HLB value of approximately 8.7; Neodol 25-1.3 which has an HLB value of approximately 4.3; Neodol 25-2.5 which has an HLB value of approximately 7.1; Neodol 23-1 which has an HLB value of approximately 3.7; and Tergitol 15-S-3 which has an HLB value of approximately 8. Tomodol surfactants are available from Tomah Products, Inc. of Milton, Wis., and Neodol surfactants are available from Shell Chemical of Houston, Tex. Examples of further alkylene oxide alcohols include a C9-C11 alcohol having 3 moles of ethoxylate and an HLB value of approximately 8.9 available as Gujchem Nua-3 available from Gujarat Chemicals of Gujarat, India, a C12-C15 alcohol having 2 moles of ethoxylate available as Gujchem LA-2 having an HLB value of approximately 6.3, and a C12-C15 alcohols having 4 moles of ethoxylate available as Gujchem LA-4 having an HLB value of approximately 9.6.

The amount of the hydrophobic surfactants is generally from about 1% to about 8% by weight, desirably from about 3% to about 7% by weight, and preferably from about 4% to about 6% by weight based upon the total weight of the aqueous concentrated cleaning solution.

The cleaning compositions of the present invention are desirably free of additives although, if desired, various additives can be utilized such as corrosion inhibitors, for example Amino tri(methylene phosphonic acid) available as Dequest 200—LC that acts as general purpose, cost-effective scale inhibitor, chelant based peroxide stabilizer or borate esters, and suspending agents such as polyacrylic acid. The amount of each is generally from about 0.5% to about 10.0% by weight and desirably from about 1.0% to about 3.0% by weight based upon the total weight of the aqueous concentrated cleaning solution.

The cleaning compositions of the present invention are generally slightly acidic and have a pH of from about 4.0 to about 6.5 and preferably from about 4.5 to about 6.0. The cleaning compositions are environmentally friendly or "green" in that they are biodegradable, non-toxic, non-hazardous, preferably phosphate free, and low foaming. As noted above, cleaning compositions are biodegradable in that they are broken down into simpler chemicals by living organisms such as microorganisms and no longer have surface active properties. They are non-toxic and non-hazardous in that in concentrated form the amount of the oxidizing agent such as hydrogen peroxide is less than about 8% by weight based upon the total weight of the cleaning composition including water. Yet another decided advantage of the present invention is that the cleaning compositions are preferably free of various phosphorus containing compounds such as various phosphates, various phosphites, and the like. Phosphorous is a nutrient for plant growth; when present in excess concentrations in water, eutrophication, or excess algal growth, tends to occur, leading to severe deterioration of the water body. Moreover, non-biodegradable surfactants are toxic to aquatic life and can make oil and grease removal difficult. Generally, the amount of any phosphorus containing compounds is about 5% by weight or less, desirably about 3% or 1% by weight or less, and preferably entirely free, of any parts by weight of phosphorus based upon the total amount by weight of the diluted (end use) cleaning solution including water. The low foaming properties of the cleaning compositions at different temperatures of the present invention are also particularly advantageous since otherwise the existence of foam would retard or inhibit pumping of the compositions in high impingement washers/manual applications and also would be detrimental to the cleaning process, since it would prevent effective amounts of the surfactant system to contact the substrate to be cleaned.

The cleaning compositions are readily prepared by adding the various ingredients together in any order and mixing. Thus, the oxidizing agent, the hydrophilic surfactant having an HLB value of 10 to 20; the hydrotrope, the UV analyzable surfactant and the optional hydrophobic surfactant having an HLB value of less than 10 are added to water in the above noted amounts to form a concentrated cleaning composition solution.

A further desired aspect of the present invention is that the concentrated cleaning solutions are mixed with an alkaline solution/formulated alkaline cleaner containing an alkali hydroxide to maximize the cleaning power of the solution generally prior to use. Suitable alkali compounds contain strong bases such as sodium hydroxide, and potassium hydroxide. Suitable alkaline solutions/formulated cleaners can be made or are commercially available such as CIP100 or CIP130 or CIP150 or ProKlenz 1000 made by STERIS Corporation of Mentor, Ohio. These alkaline compositions additionally contain chelating agents including various amine compounds such as triethylamine (TEA), ethylenediaminetetraacetic acid (EDTA), trisodium salt of methylglycinediacetic acid ($Na_3MGDA$), and the like, and various bicarbonates such as sodium bicarbonate and potassium bicarbonate. A small amount of various surfactants such as an amphoteric surfactant can also be utilized.

An effective amount of the various alkaline solutions is utilized to increase the pH of the cleaning solution from about 9 to about 14 and desirably from about 11 to about 13. Usually the amount of an alkali hydroxide in the alkaline solution is only from about 1% to about 4% or 5% by weight and only a small amount of the alkali solution is utilized in the diluted aqueous cleaning solution so that the total amount of the alkali hydroxide therein is about 0.01% to about 2.0% by weight.

The concentrated cleaning compositions of the present invention; either with or without an alkaline compound before being applied to a desired substrate are generally diluted with a solvent such as alcohol, or preferably water, to achieve a desired or safe level of the oxidizing agent. For example, with regard to hydrogen peroxide, when diluted with other alkaline solution or formulated cleaner and water, the initial concentration of from about 2% to about 8% by weight based upon the total weight of the aqueous cleaning composition is reduced to 0.005% or 0.01% to about 1.9% by weight and desirably from about 0.02% to about 0.5% by weight. Accordingly, all other components such as the various surfactants, the UV detectable surfactant, etc., are also diluted but maintain generally the same ratios with respect to one another.

The formation of the concentrated solution is desired with regard to initial storage, transportation, and any subsequent storage before use. As noted above, the cleaning compositions surprisingly yield synergistic results with regard to stability of the oxidizing agent such as the preferred hydrogen peroxide and have very low decomposition rates, even in the presence of an alkaline compound. Accelerated tests have indicated that concentrated hydrogen peroxide solutions will essentially be stable up to about three years at ambient temperature in the absence of any alkaline compound. Even when a concentrated 5% by weight hydrogen peroxide solution was diluted with water to approximately 0.20% by weight of hydrogen peroxide and mixed with a small amount of a diluted alkaline solution so that the amount of the alkali such as sodium hydroxide was about 0.20% by weight in the aqueous diluted hydrogen peroxide solution and aged for eleven days at ambient temperature conditions, i.e, 19° C. to 22° C. at an alkaline pH such as 12.9, only about 50% or less loss, desirably only about 40% or less loss, and preferably only about 35% or less loss by weight of hydrogen peroxide occurred due to degradation. This degradation did not compromise the total cleaning performance of the combined solutions.

The cleaning compositions of the present invention with or without the alkaline compound can be applied to numerous substrates such as articles, equipment, and the like to remove various residues therefrom. Examples of substrates include chemical reaction vessels and treatment equipment, pharmaceutical containers and equipment, medical equipment, surgical instruments, food and foodstuffs and processing equipment therefore, and various types of personal care and cosmetic items such as Duac Topical Gel—a carbomer based aqueous gel (hard to clean the polymer), Johnson's Diaper Rash—polymer based oily/greasy (hydrophobic) soil with zinc oxide, L'Oreal Waterproof mascara—hydrophobic polymeric soils with pigments and iron oxide, and Sudafed 24 hr.—tablet with cellulose and other polymers and titanium dioxide. Other substrates include various storage vessels, tanks, pipes, pumps, valves, heat exchangers, driers, and the like. The cleaning composition with or without the alkaline compound can be applied to the substrates in any conventional matter such as by brushing, spraying, coating, and the like, or the substrate can be submerged in the cleaning composition optionally containing the alkaline compound with optional agitation.

The cleaning compositions of the present invention that are generally utilized with the alkaline compound typically have superior cleaning properties and are effective with regard to various materials such as soils or fluids that upon drying or baking leave a residue. Residues include polymers such as high molecular weight homo- or copolymers, resins including vegetable-derived mixtures of carboxylic acids, oils, terpenes, and other residues from plants and/or animals, various gums, varnishes, adhesives, rosins, and the like, that can, for example be used as thickening agents or ingredients of various products. Other residues include modified or natural materials of the cellulose family such as hydroxypropyl methyl cellulose, natural gel such as alginates, pre-gelatinized starch, and the like. Still other residues are derived from dried bodily fluids such as mucous, proteinaceous materials, and blood.

Once the cleaning compositions of the present invention have been applied in a manner as noted above to the residue located on a substrate, they are allowed to wet the residue by soaking, scrubbing, impregnating, saturating, etc. the same. After sufficient amount of time at a desired temperature and concentration that are generally readily predetermined, the substrate is rinsed at least once preferably with water although other suitable solvents can be utilized.

A distinct advantage of the present invention is that verification of the removal of the cleaning compositions can readily be determined due to inclusion of analyzable surfactant. For example, the rinse water is analyzed as by swabbing a substrate surface and obtaining rinse water therefrom, or as by obtaining an aliquot of the last rinse water and measuring for any remaining cleaning composition using high performance liquid chromatography. The swab recovery or rinse water solution can be injected onto a reverse phase column where the UV analyzable surfactant such as Ethylan HB4 can be eluted as a single chromatographic peak using isocratic mobile phases of acetonitrile-water or methanol-water. The analyte (Ethylan HB4) can be detected as it elutes from the column using a standard UV detector set to measure the analyte absorbance at 270 nm. Naturally, if any cleaning composition is detected, the substrate is further rinsed and retested. The substrate is generally considered to be cleaned when the verification test of any cleaning composition remaining in the rinse water or swab is generally less than about 20 parts and desirably less than about 10 parts per million (ppm). That is, the peak at approximately 270 nanometers is generally non-existent. Utilization of the cleaning compositions of the present invention thus eliminates any need to obtain rinse water samples and subject the same to chemical analysis which can require many minutes and even hours to conduct. It also is a validatable cleaning method that is customer friendly since it dramatically reduces downtime and is compliant to the demands of the regulatory agencies.

The invention will be better understood by reference of the following examples with serve to explain but not to limit the present invention.

Table 1 sets forth cleaning formulations of the present invention as well as various controls.

TABLE 1

Formulations of Cleaning Solutions

| Material | Type of Ingredient | Wt % A | B | C | D |
|---|---|---|---|---|---|
| Hydrogen Peroxide | oxidizing agent | 5.0 | 5.0 | 5.0 | 5.0 |
| Ethylan HB4 | UV analyzable surfactant | 5.0 | 5.0 | 5.0 | 5.0 |
| Berol AG 6206 | hydrotropic surfactant | — | 6.9 | 13.8 | — |
| Berol 260 | hydrophilic surfactant | — | 4.0 | 4.0 | — |
| Berol 840 | hydrophilic surfactant | — | 1.8 | 1.8 | — |
| Tergitol L 64 | hydrophobic surfactant | — | — | — | 5 |
| Deionized water | | to 100 | to 100 | to 100 | to 100 |

Formulation A relates to the use of hydrogen peroxide with only the UV analyzable surfactant and does not contain any hydrophilic, hydrophobic, or hydrotropic surfactant. Formulations B and C were made in accordance with the present invention and contain a hydrophilic surfactant, a hydrotrope surfactant and a UV detectable surfactant. Formulation D relates to a control similar to Formulation A but also utilized a hydrophobic surfactant.

Three percent by weight of these formulations were then added to a beaker containing 94% by weight of water along with 3% by weight of a CIP 100 solution (an alkaline cleaner containing 3% by weight therein of potassium hydroxide) from STERIS Corporation at 60° C. A soiled coupon (described hereinbelow) was placed in the beaker and the solution was mixed at low speed. The coupon was checked for cleaning every 15 minutes for 2 hours and observations were recorded. Two different soil coupons were tested one of which was a carbomer based soil (Duac Topical Gel from Stiefel Labs lot number L1373), and the other coupon was Johnson's Diaper Rash Cream from Johnson & Johnson lot #0134C.

TABLE 2

Results of aqueous cleaning solution (0.15% wt $H_2O_2$) with an alkaline cleaner (0.15% wt KOH) (60° C.)

| Alkaline Product | CIP 100 3% wt | CIP 100 3% wt | CIP 100 3% wt | CIP 100 3% wt | CIP 100 3% wt |
|---|---|---|---|---|---|
| Formulation | A 3% wt | B 3% wt | C 3% wt | D 3% wt | — |
| Water | 94% wt | 94% wt | 94% wt | 94% wt | 94% wt |
| Johnson's Diaper Rash Cream | Fail* gross soil | Pass** @ 1.75 hr. | Pass @ 1.25 hr. | Fail, moderate soil | Fail gross soil |
| Duac Topical Gel | | Pass @ 1.25 hr. | Pass 1.25 hr. | | Fail gross soil |

*Fail = visual soil remaining on coupon

**Pass = no visual soil on coupon and no evidence of residue by water break free testing The results for a carbomer based soil (Duac Topical Gel) show that, combination of only an alkaline cleaner with the aqueous cleaning solution of the present invention (Formulation A) did not provide the needed effective cleaning. The cleaning performance of the formulations was compared through the visual inspection and also by the water-break free testing. Nor did Formulation D which did not contain a hydrotropic surfactant and a hydrophilic surfactant provide effective cleaning. The alkaline cleaner solution by itself also failed. However, Formulations B and C of the present invention easily passed. With regard to a polymer based soil (Johnson's Diaper Rash Cream), Formulations A, D, and the alkaline cleaner failed whereas Formulations B and C of the present invention readily passed.

To demonstrate that the cleaning performance of the compositions of the present invention are not compromised by the combination with a source of alkalinity, a cleaning solution was prepared by mixing 4% wt of Formulation C (5.0% wt of $H_2O_2$) with 4% weight of CIP 100 (5% wt of KOH) in 92% weight of Dl water and aged for 11 days at ambient conditions (19-22° C.). A cleaning test was then performed against a fresh solution of the same composition at 60° C. using coupons soiled with Johnson's diaper Rash Cream. The results are set forth in Table 3.

TABLE 3

Results of cleaning a Johnson's Diaper Rash Cream with a fresh versus an 11 day old combination of alkaline cleaner plus hydrogen peroxide surfactant composition

| | | |
|---|---|---|
| Alkaline Product (0.20 wt % KOH) | CIP 100 | CIP 100 |
| Formulation (0.20 wt % $H_2O_2$) | C | C |
| Age | Fresh | 11 days |
| Johnson's Diaper Rash Cream | Pass @ 1.0 hr. | Pass @ 1.25 hr. |

*Pass = no visual soil on coupon and no evidence of residue by water break free testing The results demonstrate that even after 11 days the soil is effectively cleaned by the aged alkaline solution. The peroxide content was also measured and showed only a 35% loss of peroxide content at a pH of 12.9.

While in accordance with the patent statutes, the best mode and preferred embodiment have been set forth, the scope of the invention is not limited thereto, but rather by the scope of the attached claims.

What is claimed is:

1. An aqueous cleaning composition, consisting of;

a) at least one oxidizing agent in an amount of from about 2% to about 8% by weight based upon the total weight of said cleaning composition, said oxidizing agent is an inorganic peroxide or an organic peroxide or a salt thereof, a halogen compound, or an alkylating agent, or combinations thereof;

b) at least one hydrophilic surfactant having an HLB value of 10 to 20 in an amount of from about 2% to about 9.5% by weight based upon the total weight of said cleaning composition;

c) at least one hydrotrope surfactant comprising: a modified carboxylate or a modified carboxylic acid or a salt thereof, an organic phosphate, an organic nitrogen containing compound which is an amino compound or a fatty quaternary amine alkoxylate, or an alkyl glucoside or an alkyl polyglucoside wherein said alkyl group contains from about 8 to about 16 carbon atoms, or combinations thereof, said hydrotrope having an HLB value of greater than 20 in an amount of from about 2.5% to about 12% by weight based upon the total weight of said cleaning solution;

d) at least one ultraviolet light analyzable phenol alkoxide surfactant in an amount of from about 1% to about 8% by weight based upon the total weight of said cleaning solution, said analyzable surfactant having an analyzable functional group capable of being analyzed at a wavelength from about 250 to about 290 nanometers; and e) water.

2. The aqueous cleaning composition of claim 1, wherein said at least one oxidizing agent is hydrogen peroxide, peracetic acid, percarbonic acid, persulfuric acid, perlauric acid, perglutaric acid, magnesium peroxyphthalate, peroxomonosulfate, peroxodisulfate, sodium percarbonate, sodium perborate monohydrate, urea peroxide, a hypochlorite compound, a chlorate compound, a bleach chlorite compound, a bromate compound, an iodate compound, an iodophor compound, or an alkylating compound, or combinations thereof;

wherein said at least one hydrophilic surfactant is a nonionic surfactant; and wherein said at least one ultra-violet light analyzable phenol alkoxide surfactant is a substituted or non-substituted phenol alkoxide wherein said substituted group contains from 1 to about 8 carbon atoms, wherein the number of alkoxide repeat units is from about 1 to about 20, and wherein the HLB value of said phenol alkoxide is from about 5 to about 18.

3. The aqueous cleaning composition of claim 2, wherein the amount of said at least one oxidizing agent is from about 3% to about 7% by weight, wherein said hypochlorite compound is sodium hypochlorite, and wherein said alkylating agent is ethylene oxide, or propylene oxide;

wherein the amount of said at least one hydrophilic surfactant is from about 3.5% to about 8.0% by weight, wherein said hydrophilic surfactant has the formula R—O-$(EO)_m(PO)_n$—R wherein R is an alkyl having from 1 to about 13 carbon atoms, wherein R' is an alkyl having from 1 to 5 carbon atoms or hydrogen, wherein m is an integer of from 1 to about 10, and wherein n is zero or 1 to about 10;

wherein the amount of said at least one hydrotrope surfactant is from about 4.0% to about 10% by weight, wherein said HLB value of said hydrotrope is greater than 20 to about 35; and wherein the amount of said at least one ultra-violet light analyzable surfactant is from about 3% to about 7% by weight, wherein said alkoxide repeat unit contains from 2 to about 4 carbon atoms and wherein the number of said repeat units is from about 3 to about 6.

4. The aqueous cleaning composition of claim 3, wherein said at least one oxidizing agent is hydrogen peroxide, peracetic acid, or sodium hypochlorite, or combinations thereof;

wherein said at least one hydrophilic surfactant has an HLB value of from about 10.5 to about 18, wherein R is from about 8 to about 13, wherein m is from about 3 to about 6, wherein n is zero, and wherein R' is hydrogen;

wherein said at least one hydrotrope surfactant is said alkyl glucoside, or said alkyl polyglucoside; and wherein said alkylene oxide repeat group of said at least one ultra-violet light analyzable surfactant is ethylene oxide, and wherein said phenol is not substituted.

5. The aqueous cleaning composition of claim 4, wherein the amount of said at least one oxidizing agent is from about 4% to about 6% by weight;

wherein the amount of said at least one hydrophilic surfactant is from about 4.5 to about 7, and wherein m is from about 4 to about 6;

wherein the amount of said at least one hydrotrope surfactant is from about 5.5% to about 8.5% by weight; and wherein the amount of said at least one ultra-violet light analyzable surfactant is from about 4% to about 6% by weight, wherein the number of alkoxide repeat units' is about 4, and wherein said analyzable wavelength is from about 265 to about 275 nanometers.

6. A process for making a cleaning composition consisting of:

adding together in any order at least one oxidizing agent in an amount of from about 2% to about 8% by weight based upon the total weight of said cleaning composition, said oxidizing agent comprising an inorganic peroxide or an organic peroxide or a salt thereof, a halogen compound, or an alkylating agent, or combinations thereof;

at least one surfactant having an HLB value of 10 to 20 in an amount of from about 2% to about 9.5% by weight based upon the total weight of said cleaning composition;

at least one hydrotrope surfactant having an HLB value of greater than 20 in an amount of from about 2.5% to about 12% by weight based upon the total weight of said cleaning solution, wherein said hydrotrope surfactant is of a modified carboxylate or a modified carboxylic acid or a salt thereof, an organic phosphate, an organic nitrogen containing compound which is an amino compound or a fatty quaternary amine alkoxylate, or an alkyl glucoside or an alkyl polyglucoside wherein said alkyl group contains from about 8 to about 16 carbon atoms, or combinations thereof;

at least one ultraviolet light analyzable phenol alkoxide surfactant in an amount of from about 1% to about 8% by weight based upon the total weight of said cleaning solution, said analyzable surfactant having an analyzable functional group capable of being analyzed at a wavelength from about 250 to about 290 nanometers; and water.

7. A process according to claim 6, wherein said at least one ultra-violet light analyzable phenol alkoxide surfactant is a substituted or non-substituted phenol alkoxide wherein said substituted group contains from 1 to about 8 carbon atoms, wherein the number of alkoxide repeat units is from about 1 to about 20, and wherein the HLB value of said phenol alkoxide is from about 5 to about 18.

8. A process according to claim 7, wherein the amount of said at least one oxidizing agent is from about 3% to about 7% by weight, wherein said at least oxidizing agent is hydrogen peroxide, peracetic acid, percarbonic acid, persulfuric acid, perlauric acid, perglutaric acid, magnesium peroxyphthalate, peroxomonosulfate, peroxodisulfate, sodium percarbonate, sodium perborate monohydrate, urea peroxide, a hypochlorite compound, a chlorate compound, a bleach chlorite compound, a bromate compound, an iodate compound, an iodophor compound, or an alkylating compound, or combinations thereof;

wherein said at least one surfactant having an HLB value of 10 to 20 is a nonionic hydrophilic surfactant, wherein the amount of said at least one hydrophilic surfactant is from about 3.5% to about 8.0% by weight, wherein said hydrophilic surfactant has the formula R—O-$(EO)_m(PO)_n$—R' wherein R is an alkyl having from 1 to about 13 carbon atoms, wherein R' is an alkyl having from 1 to 5 carbon atoms or hydrogen, wherein m is an integer of from 1 to about 10, and wherein n is zero or 1 to about 10.

9. A process according to claim 8, wherein the amount of said at least one hydrotrope surfactant is from about 4% to about 10% by weight, wherein said HLB value of said hydrotrope is greater than 20 to about 35, wherein said at least one hydrotrope surfactant is said alkyl glucoside, or said alkyl polyglucoside;

wherein the amount of said at least one ultra-violet light analyzable surfactant is from about 3% to about 7% by weight, wherein said alkoxide repeat unit contains from 2 to about 4 carbon atoms and wherein the number of said repeat units is from about 3 to about 6, wherein said alkylene oxide repeat group of said at least one ultra-violet light analyzable surfactant is ethylene oxide, and wherein said phenol is not substituted;

wherein said at least one oxidizing agent is hydrogen peroxide, peracetic acid, or sodium hypochlorite, or combinations thereof; and wherein said at least one hydrophilic surfactant has an HLB value of from about 10.5 to about 18, wherein R is from about 8 to about 13, wherein m is from about 3 to about 6, wherein n is zero, and wherein R' is hydrogen.

10. A process according to claim 9, wherein the amount of said at least one oxidizing agent is from about 4% to about 6% by weight;

wherein the amount of said at least one hydrophilic surfactant is from about 4.5 to about 7, and wherein m is from about 4 to about 6;

wherein the amount of said at least one hydrotrope surfactant is from about 5.5% to about 8.5% by weight; and wherein the amount of said at least one ultra-violet light analyzable surfactant is from about 4% to about 6% by weight, wherein the number of alkoxide repeat units is about 4, and wherein said analyzable wavelength is from about 265 to about 275 nanometers.

* * * * *

UNITED STATES PATENT AND TRADEMARK OFFICE

CERTIFICATE OF CORRECTION

PATENT NO. : 7,781,388 B2
APPLICATION NO. : 11/417584
DATED : August 24, 2010
INVENTOR(S) : Stavroula Maria Heintz, Shannon K. Campbell and Gurusamy Manivannan It is certified that error appears in the above-identified patent and that said Letters Patent is hereby corrected as shown below:

Column 15 (Claim 3), line 33, "R-O-(EO)m(PO)n-R" should be -- R-O-(EO)m(PO)n-R'- --.

Column 16 (Claim 5), line 3, "units'" should be --units--.

Signed and Sealed this

Sixteenth Day of November, 2010

David J. Kappos

David J. Kappos
*Director of the United States Patent and Trademark Office*